US009828127B2

(12) United States Patent
Shaker et al.

(10) Patent No.: US 9,828,127 B2
(45) Date of Patent: Nov. 28, 2017

(54) APPARATUS FOR BAGGING ICE INCLUDING ICE LEVEL AND LOAD SENSORS

(71) Applicant: GW Services, LLC, Vista, CA (US)

(72) Inventors: James Shaker, Mesa, AZ (US); Paul Bareford, Concord, MA (US); Vince Shaker, Mesa, AZ (US)

(73) Assignee: GW Services, LLC, Vista, CA (US)

( * ) Notice: Subject to any disclaimer, the term of this patent is extended or adjusted under 35 U.S.C. 154(b) by 666 days.

(21) Appl. No.: 14/248,168

(22) Filed: Apr. 8, 2014

(65) Prior Publication Data

US 2014/0290187 A1 Oct. 2, 2014

Related U.S. Application Data

(63) Continuation of application No. 12/612,538, filed on Nov. 4, 2009, now Pat. No. 8,689,523, which is a (Continued)

(51) Int. Cl.

| | |
|---|---|
| ***B65B 57/14*** | (2006.01) |
| ***B65B 1/32*** | (2006.01) |
| ***F25C 5/00*** | (2006.01) |
| ***B65B 1/48*** | (2006.01) |
| ***B65B 1/46*** | (2006.01) |

(Continued)

(52) U.S. Cl.

CPC ..... *B65B 57/14* (2013.01); *B65B 1/32* (2013.01); *B65B 1/36* (2013.01); *B65B 1/46* (2013.01); *B65B 1/48* (2013.01); *B65B 7/02* (2013.01); *B65B 43/16* (2013.01); *F25C 5/002* (2013.01);

(Continued)

(58) Field of Classification Search

CPC .... B65B 1/06; B65B 1/12; B65B 1/32; B65B 1/36; B65B 1/46; B65B 1/48; B65B 57/14; F25C 5/002; F25C 5/187

USPC ..... 53/502, 503, 570, 571, 573, 284.7, 127, 53/167, 384.1; 62/60, 322, 331

See application file for complete search history.

(56) References Cited

U.S. PATENT DOCUMENTS

| | | | | |
|---|---|---|---|---|
| 2,116,300 A | | 5/1938 | Campos | |
| 2,142,920 A | * | 1/1939 | Rose | B65B 1/48 209/586 |

(Continued)

FOREIGN PATENT DOCUMENTS

| | | | | |
|---|---|---|---|---|
| ES | 2171120 A1 | | 8/2002 | |
| FR | 2271984 A1 | * | 12/1975 | B65B 1/32 |

(Continued)

*Primary Examiner* — Stephen F Gerrity

(74) *Attorney, Agent, or Firm* — Womble Carlyle Sandridge & Rice, LLP

(57) ABSTRACT

An ice bagging assembly and related method with a horizontal ice bag cassette, a pair of opposing ice bag ply graspers configured to move an empty ice bag from the horizontal ice bag cassette to a vertical position to receive cubed ice before it is sealed shut and dropped to an ice bag merchandiser. The opposing graspers may be configured as rotating wheels and may have a grasping sensor. The ice bag cassette may be slidably and tiltably supported for easy replacement of horizontal bags. A load sensor, optical or mechanical, may be associated with the ice hopper to sense how much ice has been put in each bag. A pair of angled guides may guide a hopper into a support frame for the system.

3 Claims, 7 Drawing Sheets

Related U.S. Application Data continuation-in-part of application No. 12/579,613, filed on Oct. 15, 2009, now Pat. No. 8,528,302.

(60) Provisional application No. 61/168,312, filed on Apr. 10, 2009.

(51) Int. Cl.

| | |
|---|---|
| ***B65B 43/16*** | (2006.01) |
| ***B65B 7/02*** | (2006.01) |
| ***B65B 1/36*** | (2006.01) |
| *B65B 51/14* | (2006.01) |

(52) U.S. Cl.

CPC ..... *B65B 51/146* (2013.01); *F25D 2331/801* (2013.01)

(56) References Cited

U.S. PATENT DOCUMENTS 2,155,895 A 4/1939 Gibson, Jr.
2,436,955 A 3/1948 Wesley
2,584,726 A 2/1952 Mcomber
2,660,394 A * 11/1953 Skeuse et al. ..... B65B 1/32 141/248
2,725,168 A 11/1955 Lindstaedt et al.
2,810,999 A 10/1957 Spriggs
2,923,399 A 2/1960 Woodman
2,950,589 A 8/1960 Litchard
2,986,897 A 6/1961 Howard
3,009,336 A 11/1961 Bayston et al.
3,151,668 A 10/1964 Zimmermann
3,208,194 A 9/1965 Johnson et al.
3,430,409 A 3/1969 Manfredonia et al.
3,509,689 A 5/1970 Perrin
3,559,424 A 2/1971 Nelson
3,566,578 A 3/1971 Thorne et al.
3,618,733 A 11/1971 Winsett
3,654,771 A 4/1972 Kuebler
3,702,625 A * 11/1972 Schmidt ..... B65B 1/04 141/1
3,712,019 A 1/1973 Lamka et al.
3,719,307 A 3/1973 Larson
3,727,374 A 4/1973 Williams
3,789,570 A 2/1974 Mullins, Jr.
3,807,123 A 4/1974 Kihnke
3,807,193 A 4/1974 Mckenney et al.
3,830,038 A 8/1974 Propst
3,871,587 A * 3/1975 Gail ..... A01C 15/00 239/141
3,889,449 A 6/1975 Membrino
3,897,676 A 8/1975 Membrino
3,913,343 A * 10/1975 Rowland et al. ..... F25C 5/002 222/241
3,916,603 A 11/1975 Kristiansen
3,918,266 A 11/1975 Gindy et al.
3,977,483 A 8/1976 Greanias
4,013,199 A 3/1977 Brown
4,078,358 A 3/1978 Henderson
4,132,049 A 1/1979 Mullins, Jr.
4,172,349 A 10/1979 Lipes
4,182,451 A * 1/1980 Watson ..... B65B 1/48 209/524
4,227,377 A * 10/1980 Miller ..... F25C 5/187 222/56
4,262,803 A 4/1981 Nausedas et al.
4,291,517 A 9/1981 Lipes
4,320,615 A 3/1982 Gmur
4,345,629 A 8/1982 Inglett, Jr.
4,348,872 A 9/1982 Hill
4,368,608 A 1/1983 Ray
4,404,817 A 9/1983 Cox, III
4,519,504 A 5/1985 Nausedas
4,541,228 A 9/1985 Petersen
4,570,419 A 2/1986 Tinsley
4,607,478 A 8/1986 Maglecic
4,669,375 A * 6/1987 Newsom et al. ..... B30B 9/3007 100/215
4,676,285 A 6/1987 Schieser et al.
4,689,937 A 9/1987 Finan, Sr. et al.
4,694,661 A 9/1987 Landers
4,878,523 A 11/1989 Balsamico et al.
4,942,983 A * 7/1990 Bradbury ..... F25C 5/007 141/360
4,946,073 A * 8/1990 Brill et al. ..... F25C 5/002 222/129.4
4,976,091 A * 12/1990 Salemka et al. ..... G05D 9/12 53/467
5,060,484 A * 10/1991 Bush et al. ..... F25C 5/187 340/621
5,070,674 A 12/1991 Lerner et al.
5,088,300 A 2/1992 Wessa
5,100,000 A 3/1992 Huseman
5,109,651 A 5/1992 Stuart
5,142,841 A 9/1992 Cappi et al.
5,201,166 A 4/1993 Johnsen
5,241,804 A * 9/1993 Tsuruta et al. ..... B65B 9/12 53/504
5,277,016 A 1/1994 Williams et al.
5,337,541 A 8/1994 Gmuer
5,400,838 A 3/1995 Schjerven et al.
5,440,863 A 8/1995 Toya et al.
5,442,898 A 8/1995 Gabree et al.
5,444,962 A 8/1995 Bonnet
5,458,851 A 10/1995 Schroeder et al.
5,473,865 A 12/1995 Tanaka et al.
5,581,982 A 12/1996 Schroeder et al.
5,630,310 A 5/1997 Chadwell
5,706,660 A * 1/1998 Shank et al. ..... F25C 5/187 222/56
5,708,223 A * 1/1998 Wyss ..... G07F 17/0071 62/129
5,822,955 A 10/1998 Woosley et al.
D407,092 S 3/1999 Weaver
6,006,495 A 12/1999 Varichon et al.
6,045,840 A * 4/2000 Morikawa et al. ..... A21C 3/04 425/135
6,112,539 A 9/2000 Colberg
6,266,945 B1 7/2001 Schroeder
6,308,501 B1 10/2001 Brinkman
6,324,855 B1 * 12/2001 Mullis ..... F25C 5/187 340/686.6
6,340,036 B1 * 1/2002 Toyoizumi et al. ..... B65B 1/12 141/275
6,354,338 B1 3/2002 Takemoto
6,453,646 B1 9/2002 Schneider
6,474,048 B1 11/2002 Metzger et al.
6,827,529 B1 12/2004 Berge et al.
6,904,946 B2 6/2005 James
7,062,892 B2 6/2006 Metzger
7,207,156 B2 4/2007 Metzger
7,257,935 B1 * 8/2007 Wehrmann ..... B65B 37/08 53/139.5
7,421,834 B1 9/2008 Doolan
7,426,812 B2 9/2008 Metzger
7,426,945 B2 9/2008 Dalton et al.
7,497,062 B2 3/2009 Metzger
7,624,773 B2 12/2009 Maxwell
7,681,408 B2 3/2010 Hobson et al.
7,810,301 B2 10/2010 Metzger
8,122,689 B2 2/2012 Pape
8,122,692 B2 2/2012 Inoue et al.
8,132,392 B2 3/2012 Metzger
8,137,252 B2 3/2012 Yokota et al.
8,210,354 B2 7/2012 Alvarado et al.
8,245,488 B2 8/2012 Dunn
8,256,195 B2 9/2012 Pape
8,356,850 B1 1/2013 Starkweather et al.
8,468,784 B2 6/2013 Metzger
8,484,935 B2 7/2013 Leblanc et al.
2002/0133309 A1 * 9/2002 Hardt ..... A01D 41/1277 702/129
2004/0107676 A1 6/2004 Murray

(56) References Cited

U.S. PATENT DOCUMENTS

2004/0216481 A1 11/2004 James et al.
2005/0051232 A1 3/2005 Schmoll et al.
2005/0103398 A1* 5/2005 Dalton et al. ..... B65B 1/12 141/83
2006/0005553 A1* 1/2006 Metzger ..... B65B 1/36 62/135
2006/0151059 A1 7/2006 Ours et al.
2007/0209330 A1* 9/2007 Metzger ..... B65B 1/36 53/469
2007/0240441 A1* 10/2007 Hobson et al. ..... B65B 43/36 62/233
2007/0267086 A1 11/2007 Dunn
2008/0022635 A1 1/2008 Metzger
2008/0101911 A1 5/2008 Hulchanski
2008/0110129 A1 5/2008 LeBlanc et al.
2008/0110132 A1 5/2008 Yan Ruz et al.
2008/0110186 A1* 5/2008 Maples ..... F25C 5/187 62/137
2008/0135129 A1* 6/2008 Rhee et al. ..... B65B 1/06 141/83
2008/0283145 A1 11/2008 Maxwell
2008/0295462 A1 12/2008 Metzger
2009/0013985 A1* 1/2009 Little et al. ..... F24B 1/028 126/67
2009/0120039 A1 5/2009 Metzger
2010/0263335 A1 10/2010 Pape
2010/0268375 A1 10/2010 Pape
2010/0313524 A1 12/2010 Pape et al.
2011/0308203 A1 12/2011 Strating et al.
2012/0031054 A1 2/2012 Broadbent
2012/0070264 A1 3/2012 Pape
2012/0111449 A1 5/2012 Hsu
2012/0163951 A1 6/2012 Johnsen et al.
2012/0186202 A1 7/2012 Pandurangan et al.
2012/0228246 A1 9/2012 Alvarado et al.
2012/0247066 A1 10/2012 Dunn et al.
2013/0036716 A1 2/2013 Tsutsumi et al.
2013/0067870 A1 3/2013 Actis
2013/0111857 A1 5/2013 Rabiea

FOREIGN PATENT DOCUMENTS

JP 2989110 B2 * 12/1999 ..... B29B 7/24
WO WO0001582 A1 1/2000

* cited by examiner

APPARATUS FOR BAGGING ICE INCLUDING ICE LEVEL AND LOAD SENSORS

CROSS REFERENCE TO RELATED APPLICATIONS

This Application is a continuation of co-pending U.S. patent application Ser. No. 12/612,538 entitled "Ice Bagging Assembly with Accessible Hopper," filed on Nov. 4, 2009, which is a continuation-in-part application of U.S. patent application Ser. No. 12/579,613 to Shaker et al., entitled "Ice Bagging Device" which was filed on Oct. 15, 2009 and claims the benefit of the filing date of U.S. Provisional Patent Application 61/168,312 to Shaker, et al., entitled "Ice Bagging Apparatus," which was filed on Apr. 10, 2009, the disclosures of which are hereby incorporated entirely herein by reference.

BACKGROUND

1. Technical Field

Aspects of the present document relate generally to ice bagging apparatuses, and more particularly to ice bagging apparatuses configured to select and fill empty ice bags from a horizontal ice bag cassette.

2. Background Art

Ice bagging apparatuses are commonly used to fill a plurality of bags with ice for retail sales, commercial sales, and/or other uses by other consumers. Ice bagging apparatuses are useful in that, among other things, they may produce and store bags of ice in a manner that is conveniently accessible to users.

SUMMARY

Aspects of this document relate to ice bagging assemblies.

In one aspect, an ice bagging assembly having a support frame, a horizontal ice bag cassette coupled to the support frame and configured to store a plurality of empty ice bags, a bag selector coupled to the support frame and configured to select a first empty ice bag of the plurality of empty ice bags and to move the first empty ice bag from a horizontal position to an open vertical position below an ice chute, the ice chute configured to drop a plurality of ice cubes into the first open ice bag, an ice bag support below an end of the ice chute and positioned to support the first ice bag as the plurality of ice cubes drop into the first ice bag, and a sealing mechanism configured to seal an open end of the first ice bag.

Particular implementations may include one or more of the following: The assembly may further comprise an ice bag merchandiser in mechanical cooperation with the ice bagging assembly, the ice bag merchandiser configured to receive a plurality of filled, sealed ice bags from the ice bagging assembly and maintain the ice within the filled ice bags in a frozen state. The assembly may further comprise an ice cube maker in mechanical cooperation with the ice bagging assembly. The horizontal cassette may be slidably and tiltably coupled to the support frame for replacement of the plurality of empty ice bags. The assembly may further comprise an ice cube hopper in mechanical cooperation with the ice chute, the assembly further comprising at least one load sensor interposed between the ice cube hopper and the support frame. The frame may comprise a pair of angled guides on opposing inside sides of the support frame, the pair of angled guides positioned to guide the hopper into the support frame with the pair of angled guides each being lower toward a first end of the support frame and higher toward a second end of the support frame so that the ice cube hopper slides into the support frame toward a top of the support frame near the second end.

In another aspect, an ice bagging assembly may comprise a support frame, an ice bag cassette coupled to the support frame and configured to store a plurality of empty ice bags each with a first ply and a second ply defining an inside of each ice bag between the first and second plys, a bag selector coupled to the support frame and comprising a pair of opposed grasping elements configured to grasp the first ply of a first empty ice bag from the plurality of empty ice bags, wherein the bag selector is configured to move the first empty ice bag from a first position within the ice bag cassette to a second position outside the cassette such that an open end of the first empty ice bag is positioned below an ice chute, the ice chute configured to drop a plurality of ice cubes into the first open ice bag, an ice bag support below an end of the ice chute and positioned to support the ice bag as the plurality of ice cubes drop into the ice bag, and a sealing mechanism configured to seal an open end of the ice bag.

Particular implementations may include one or more of the following: The assembly may further comprise an ice bag merchandiser in mechanical cooperation with the ice bagging assembly, the ice bag merchandiser configured to receive a plurality of filled, sealed ice bags from the ice bagging assembly and maintain the ice within the filled ice bags in a frozen state. The horizontal cassette may be slidably and tiltably coupled to the support frame for replacement of the plurality of empty ice bags. The at least one pair of opposed grasping elements may comprise at least one wheel configured to rotate about an axis. The at least one pair of opposed grasping elements may comprise at least two opposed wheels, each configured to rotate about its respective axis in a direction opposite the other opposed wheel. The at least one pair of opposed grasping elements comprises at least two pairs of opposed grasping elements, each pair grasping a different one of the first and second plys. The at least two pairs of opposing grasping elements may each comprise at least one wheel configured to rotate about an axis. The at least at least one pair of grasping elements may be configured to move away from the second ply of the ice bag after grasping the first ply of the ice bag to open the ice bag. The first position may be a horizontal position and the second position may be a vertical position.

In another aspect, a method of selecting and filling each of a plurality of empty ice bags from a horizontal ice bag cassette may comprise: moving a bag selector to a first bag selector position above a horizontal ice bag cassette, grasping a first ply of one of the plurality of empty ice bags in a horizontal position in the horizontal ice bag cassette, restraining a second ply of the empty ice bag, increasing an open dimension of the open end of the empty ice bag, moving the bag selector away from the horizontal ice bag cassette after grasping the first ply of the empty ice bag, the bag selector moving to position an open end of the empty ice bag facing upward below an ice bag chute, dropping a plurality of ice cubes from the ice chute into the empty ice bag, and sealing the open end of the empty ice bag after dropping the plurality of ice cubes into the empty ice bag.

Particular implementations may include one or more of the following: Grasping a first ply may comprise moving at least one pair of grasping elements into contact with the first ply of the empty ice bag and rotating at least one grasping element of the at least one pair with respect to the other grasping element of the at least one pair to grasp the first ply. Rotating at least one grasping element may comprise rotating both grasping elements of the at least one pair of grasping elements in opposite directions to grasp the first ply. Restraining a second ply of the empty ice bag may comprise passing one or more suspension elements through the second ply of the empty ice bag in the horizontal position. The method may further comprise measuring a quantity of ice in the ice cube hopper by sensing the weight of the ice cube hopper through a sensor interposed between the ice cube hopper and a support frame for the ice cube hopper. The method may further comprise measuring a quantity of ice dropped into the empty ice bag by sensing the weight of the ice cube hopper through a sensor interposed between the ice cube hopper and a support frame for the ice cube hopper.

In still yet another aspect, a method of selecting and filling each of a plurality of empty ice bags may comprise: Moving a bag selector to a first position adjacent to an ice bag cassette, grasping a first ply of one of the plurality of empty ice bags in the ice bag cassette by moving at least one pair of grasping elements into contact with the first ply of the empty ice bag and rotating at least one grasping element of the at least one pair with respect to the other grasping element of the at least one pair to grasp the first ply, restraining a second ply of the empty ice bag, increasing an open dimension of the open end of the empty ice bag, moving the bag selector away from the ice bag cassette after grasping the first ply of the empty ice bag, the bag selector moving to position an open end of the empty ice bag facing upward below an ice bag chute, dropping a plurality of ice cubes from the ice chute into the empty ice bag, and sealing the open end of the empty ice bag after dropping the plurality of ice cubes into the empty ice bag.

Particular implementations may comprise one or more of the following: Rotating at least one grasping element may comprise rotating both grasping elements of the at least one pair of grasping elements in opposite directions to grasp the first ply. Restraining a second ply of the empty ice bag may comprise passing one or more suspension elements through the second ply of the empty ice bag in the horizontal position.

The foregoing and other aspects, features, and advantages will be apparent to those having ordinary skill in the art from the DESCRIPTION and DRAWINGS, and from the CLAIMS.

BRIEF DESCRIPTION OF THE DRAWINGS

An ice bagging assembly and associated methods of use will hereinafter be described in conjunction with the appended drawings, where like designations denote like elements, and.

DESCRIPTION

This disclosure, its aspects and implementations, are not limited to the specific components or assembly procedures disclosed herein. Many additional components and assembly procedures known in the art consistent with the intended operation of an ice bagging assembly and/or assembly procedures for an ice bagging assembly will become apparent from this disclosure. Accordingly, for example, although particular support frames, horizontal ice bag cassettes, bag selectors, plurality of ice bags, first bags, ice chutes, ice bag supports, sealing mechanisms, open ends, ice bag merchandisers, ice cube hoppers, load sensors, angled guides, ice bag cassettes, first plys, second plys, insides of ice bags, opposed grasping elements, first positions, second positions, wheels, horizontal positions, vertical positions, open dimensions, suspension elements, and implementing components are disclosed, such may comprise any shape, size, style, type, model, version, measurement, concentration, material, quantity, and/or the like as is known in the art for such ice bagging assemblies, consistent with the intended operation of an ice bagging assembly.

There are a variety of ice bagging assembly implementations disclosed herein. FIGS. 1-16 illustrate various aspects of a first particular implementations of an ice bagging assembly 2, with the following description explaining this, and other, particular implementations. An ice bagging assembly 2 (and other particular implementations of ice bagging assemblies disclosed herein) comprises a support frame 4 coupled with, and at least partially enclosing, an ice bag cassette 6, such as a horizontally-oriented ice bag cassette 6. While the particular implementations described herein show a horizontal ice bag cassette 6, it will be understood that, in some particular implementations, an ice bag cassette 6 may be oriented other than horizontally, such as vertically. Depending upon the particular implementation being used, an ice bag cassette 6 may be removable or partially-removable with respect to the support frame 4, to assist with maintenance or re-filling. In some particular implementations, an ice bag cassette 6 may be slidably and tiltably coupled to the support frame 4 to further assist with the replacement of the plurality of empty ice bags, as illustrated and described further with respect to FIG. 16.

Figure 9:
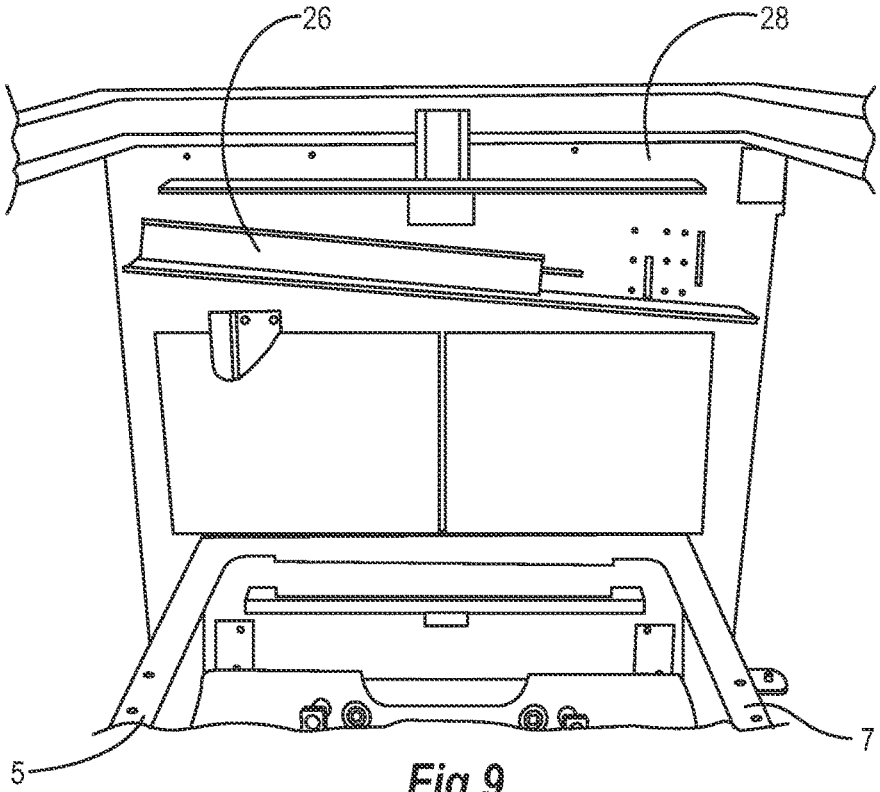
FIG. 9 illustrates an interior view of a particular implementation of an ice bagging apparatus.
Figure 10:
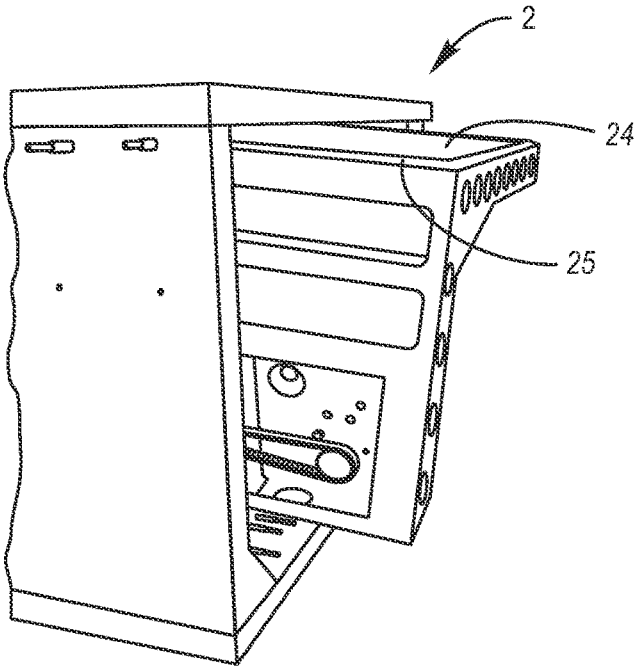
FIG. 10 illustrates an external perspective view of the ice cube hopper of FIG. 9 being positioned with respect to a support frame.
Figure 11:
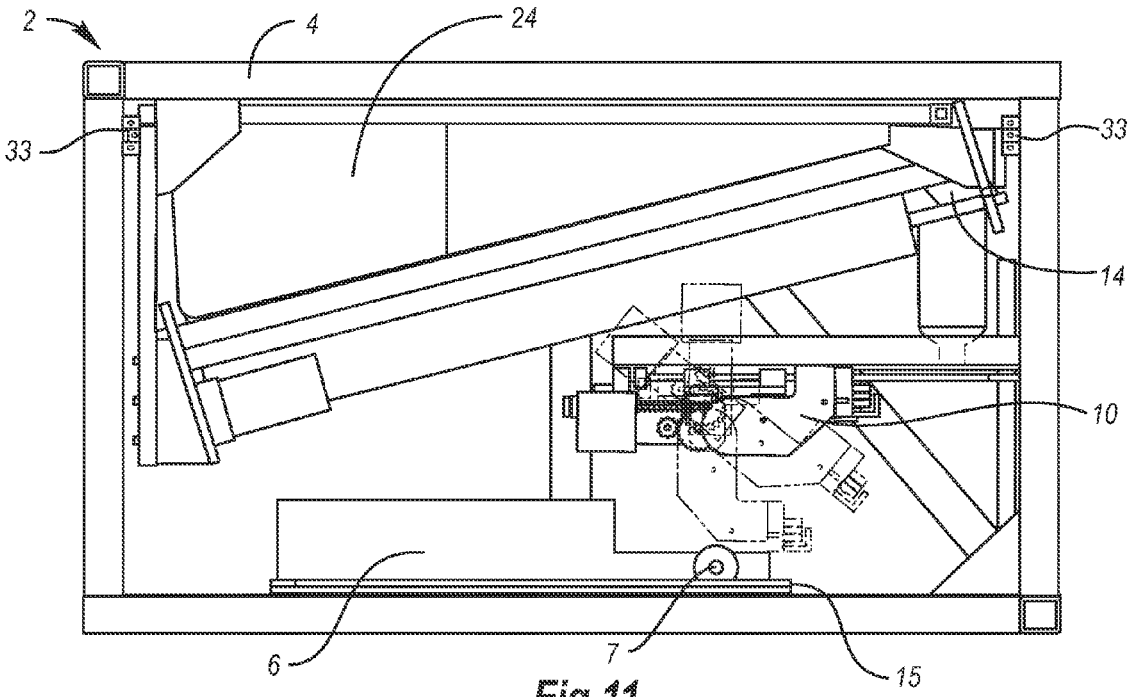
FIG. 11 illustrates a first in-use view of a particular implementation of an ice bagging apparatus with the side panel removed to show the internals of the apparatus.

In some particular implementations, such as that shown with respect to FIGS. 9 and 10, the support frame 4 comprises a pair of angled guides 26 on opposing inside sides 28 of the support frame 4. The pair of angled guides 26 are positioned to guide an ice cube hopper 24 into the frame 4 and allow the hopper 24 to be removable or semi-removable with respect to the frame in order to assist with scheduled or unscheduled maintenance and/or cleaning. In particular implementations, such as those illustrated in FIGS. 1-16, the ice cube hopper 24 may be coupled to other components of the ice bagging assembly, including, in some particular implementations, most of the components of the ice bagging assembly. In other implementations, the ice cube hopper 24 may be separate from the other components so that it is separately removable. Significantly, the pair of angled guides 26 are each lower toward a first end 3 of the support frame 4 and higher toward a second end 5 of the frame so that the ice cube hopper 24 slides into the frame 4 from an extended position (FIG. 10) in which the inside of the hopper can be cleaned toward a top of the frame near the second end 5 in an inserted position (FIG. 11). Once the ice cube hopper 24 is inserted to the second end 5 of the frame, the side of the ice cube hopper 24 at the first end 7 of the frame may be lifted or otherwise adjusted so that its top edge is substantially horizontal and thereafter maintained in that position until there is a need to access the ice cube hopper again. In some particular implementations, the ice cube hopper 24 may be completely or partially sealed with respect to a support frame 4 such as via a gasket or other sealing member (not shown) positioned between the ice cube hopper 24 and the frame 4 or top of the housing. The use of a gasket 25 between the ice cube hopper 24 and the housing of the assembly helps to keep debris and contaminants from entering the ice cube hopper 24.

As best illustrated in FIGS. 12-16, an ice bag cassette 6 is configured to store a plurality of empty ice bags 8. A plurality of empty ice bags 8 may comprise a plurality of stacked ready-to-fill individual bags. The bags may be stored on a wicket for convenient storage prior to installation. The plurality of empty ice bags 8 may comprise any commercially-available bag having opposing outer plys (such as first ply 30 and second ply 32) defining an inside of the bag between the plys (such as inside 31), along with an open-end (such as open end 20) that is capable of being sealed. As described further below, a plurality of empty ice bags 8 may be provided with an appropriate number of holes in a layer, such as the bottom layer (second ply), to transfer the plurality of empty ice bags 8 onto one or more cartridge bag loading pins 51 located in an ice bag cassette 6, and to accept one or more suspension elements 50 (which may be provided in some particular implementations and which are describe further below).

Figure 12:
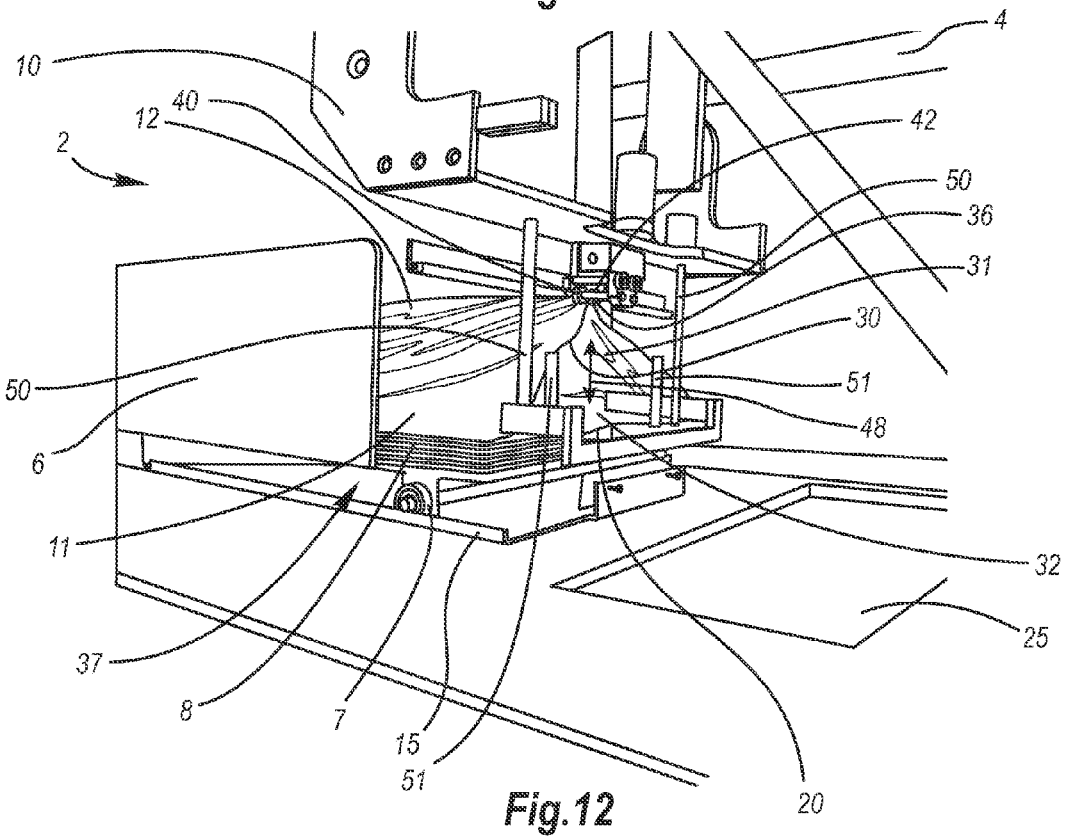
FIG. 12 illustrates a second in-use view of the ice bagging apparatus of FIG. 11.
Figure 13:
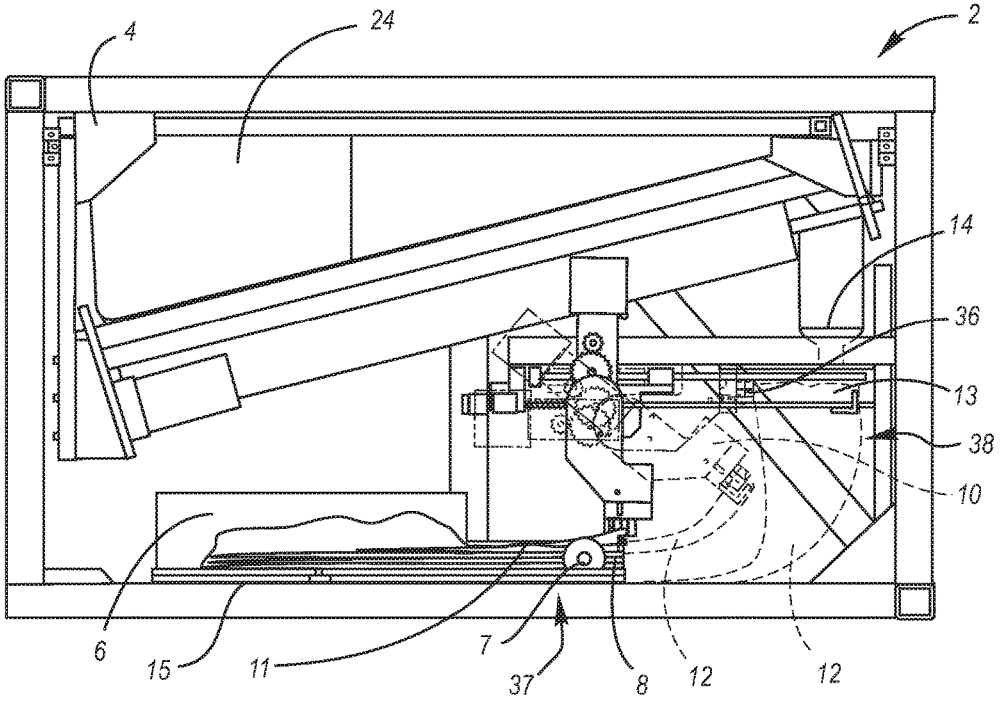
FIG. 13 illustrates a third in-use view of the ice bagging apparatus of FIG. 11.

A bag selector 10 operationally coupled to the support frame 4 is configured to select one or more empty ice bags from the plurality of empty ice bags 8. As illustrated by FIGS. 11-13, a bag selector 10 may be configured to select a first empty ice bag 12 from the plurality of empty ice bags 8. In those particular implementations comprising a ice bag cassette 6 oriented horizontally, a bag selector 10 may move the first empty ice bag 12 from a horizontal position 11 (FIGS. 11-12) to an open vertical position 13 (FIG. 13) under an ice chute 14 (such that the first empty ice bag 12 is oriented substantially vertically with an open end 20 of the bag in an open, or ready-to-load position, under the ice chute 14). In other particular implementations, such as those particular implementations where an ice bag cassette is oriented in a position other than horizontally, a bag selector 10 may move a first empty ice bag 12 from a first position 36 (which may correspond to a horizontal position 11 or any other position orientation) within an ice bag cassette or support, to a second position 38 (which may correspond to an open vertical position 13), such that the first empty ice bag 12 is oriented substantially vertically with an open end 20 of the bag in an open, or ready-to-load position, below an ice chute 14.

Figure 1:
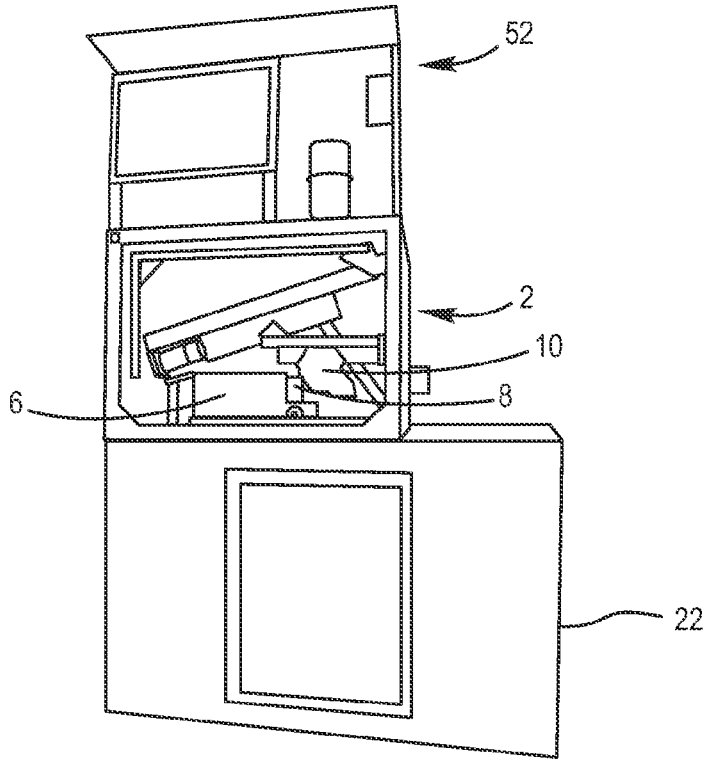
FIG. 1 illustrates a front view of a particular implementation of an ice bagging assembly with the side panel removed.
Figure 2:
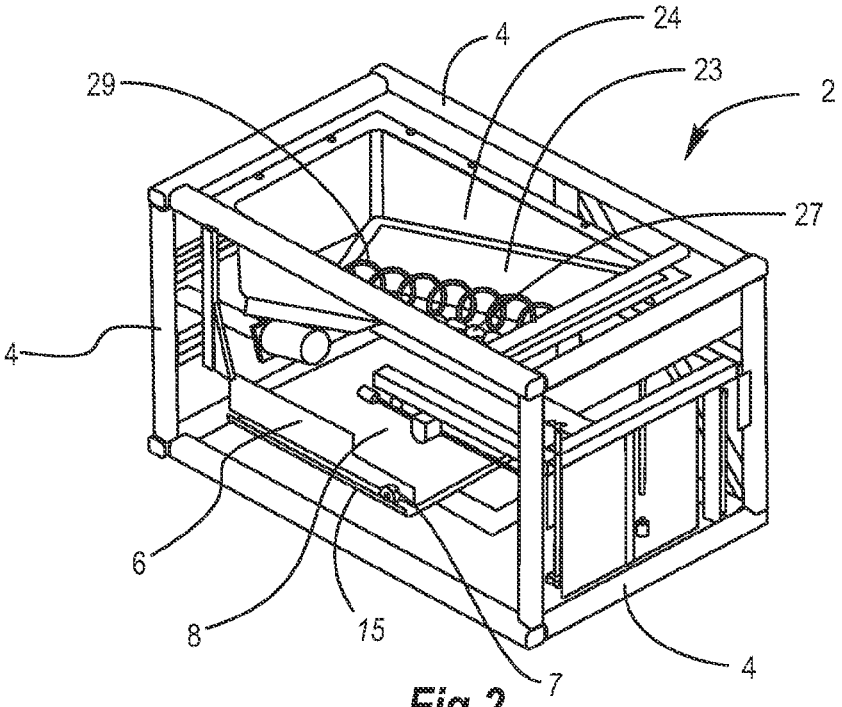
FIG. 2 illustrates an end perspective view of a particular implementation of an ice bagging apparatus with the housing shell removed.
Figure 3:
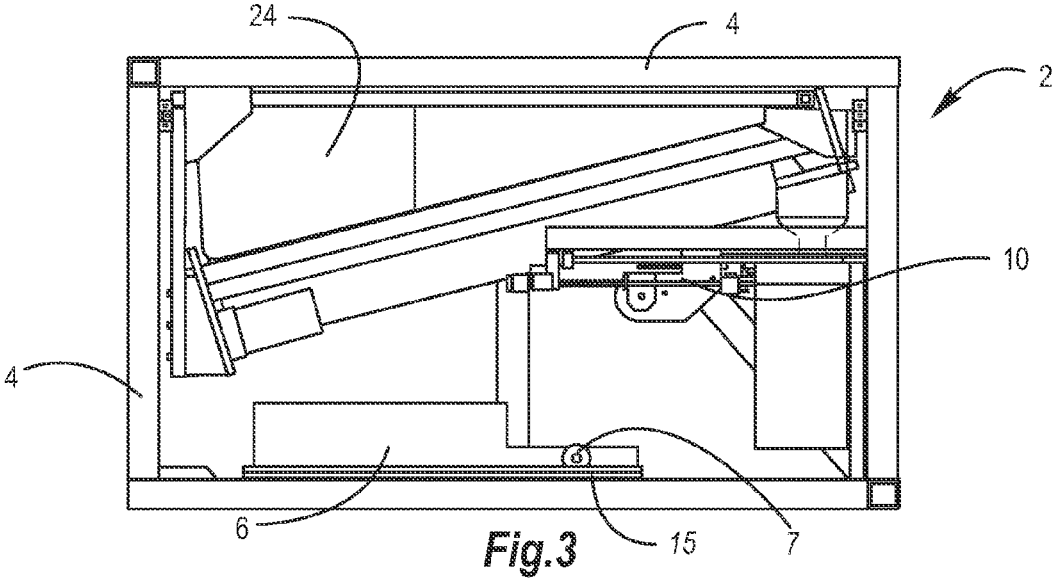
FIG. 3 illustrates a front view of the ice bagging apparatus of FIG. 1 with the side panel removed to show the inside.
Figure 4:
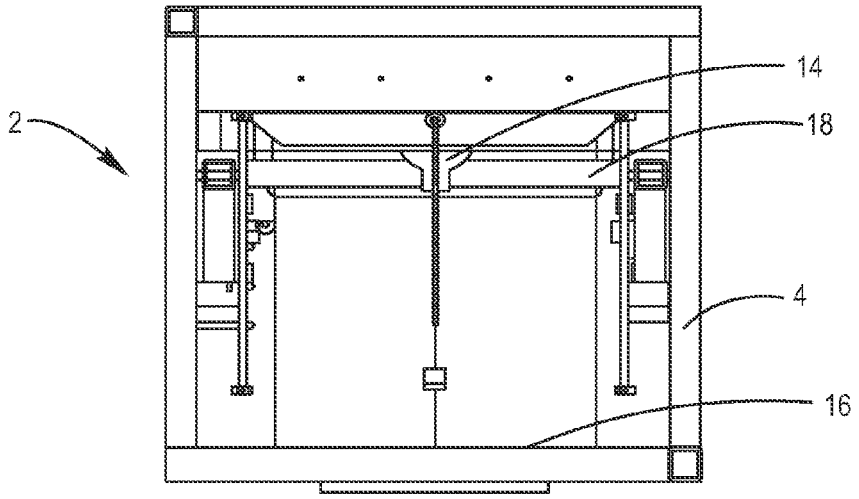
FIG. 4 illustrates a first end view of the ice bagging apparatus of FIG. 1 with the first end panel removed to show the inside.
Figure 5:
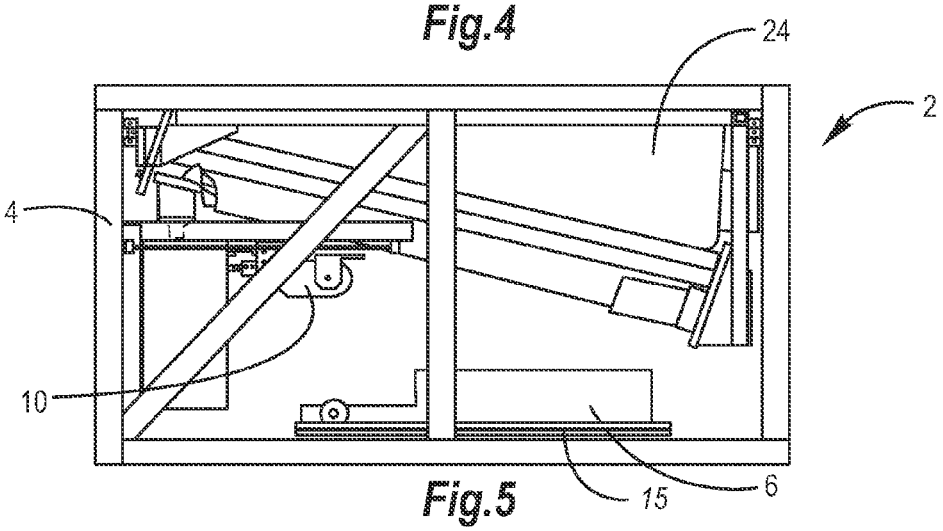
FIG. 5 illustrates a rear view of the ice bagging apparatus of FIG. 1 with rear panel removed to show the inside.
Figure 6:
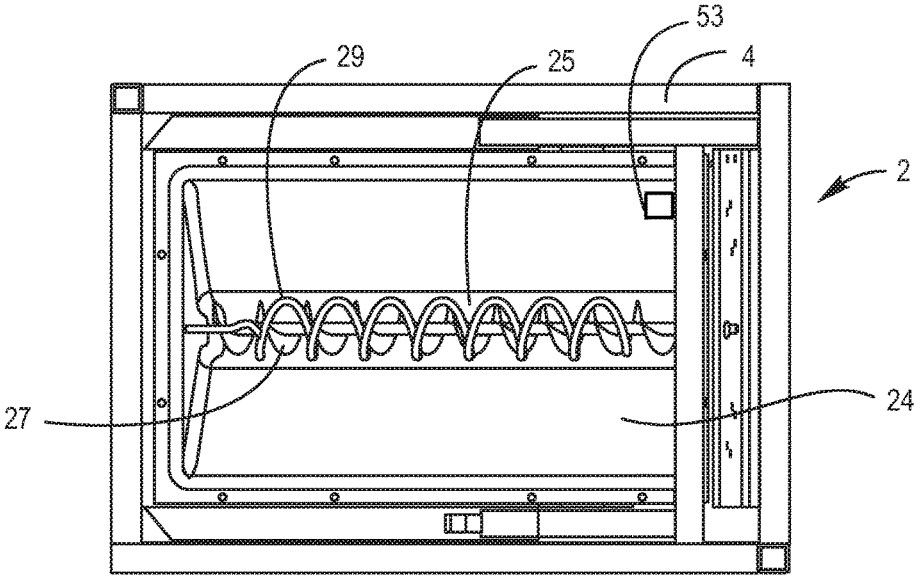
FIG. 6 illustrates a top view of the ice bagging apparatus of FIG. 1 with the top panel removed to show the inside.
Figure 7:
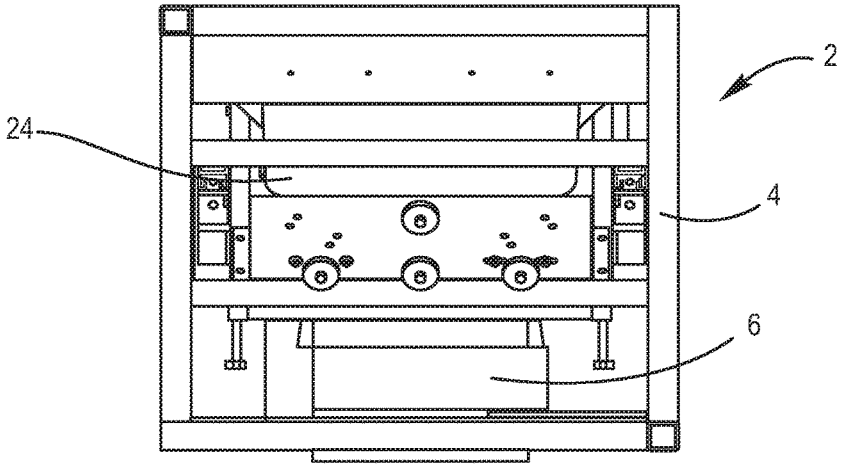
FIG. 7 illustrates a second end view of the ice bagging apparatus of FIG. 1 with the second end panel removed to show the inside.
Figure 8:
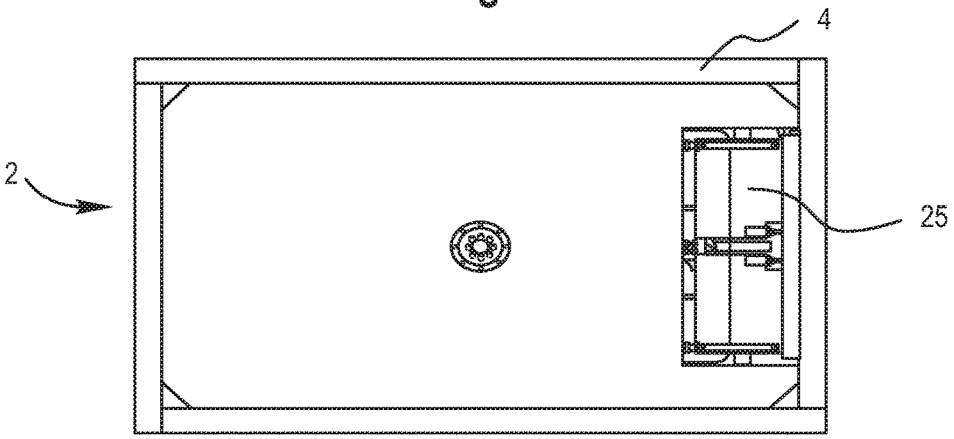
FIG. 8 illustrates a bottom view of the ice bagging apparatus of FIG. 1 with the bottom panel removed to show the inside.
Figure 14:
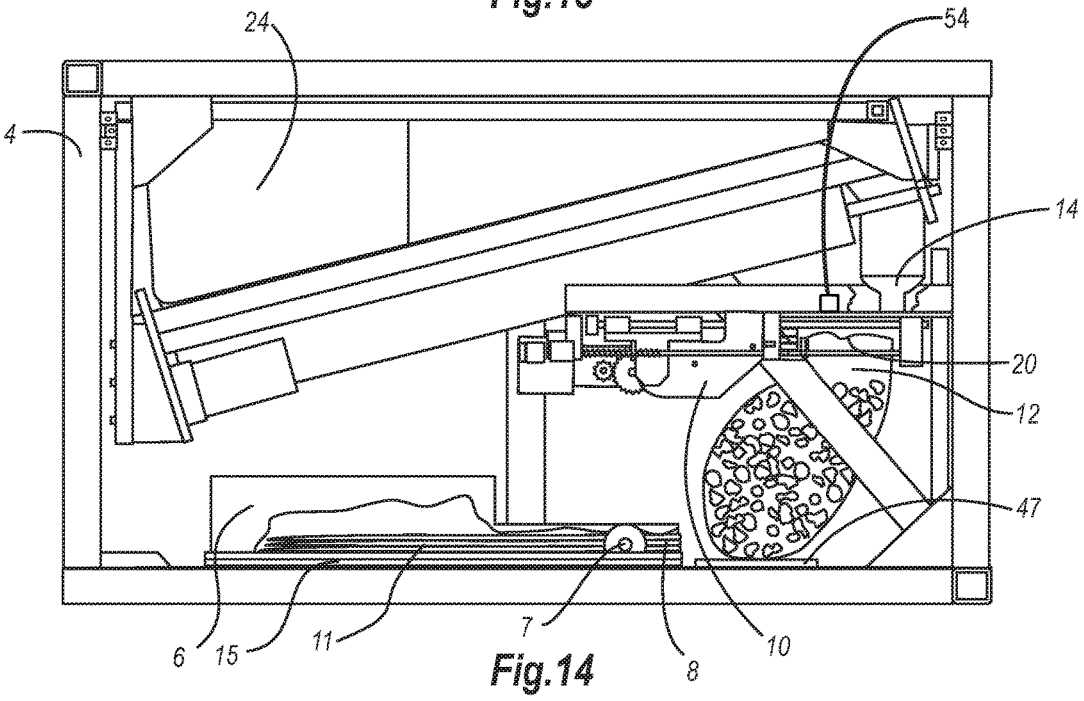
FIG. 14 illustrates a fourth in-use view of the ice bagging apparatus of FIG. 11.

In any event, as shown specifically in FIG. 14, an ice chute 14 in mechanical cooperation with an ice cube hopper 24 is configured to drop a plurality of ice cubes into a first empty ice bag 12 from the hopper 24. An ice cube hopper 24 is designed to serve as a holding area for ice cubes that are formed by a conventional commercial or other type of ice cube maker 52 (FIG. 1), and that are awaiting bagging. Ice cube makers are well known in the art. Some examples include those ice cube makers made by Hoshizaki America, Inc. of Georgia, Manitowoc Ice, Inc. of Wisconsin, and Scotsman Ice Systems of Illinois. As illustrated best in FIGS. 2-3 and 6, the floor 23 of the ice cube hopper 24 is sloped. As formed ice cubes are introduced into the hopper 24 from the ice cube maker 52, the ice cubes may settle by gravity into the low end of the hopper. As shown in FIG. 6 in particular, the hopper 24 comprises a channel 25 that runs along the length of the hopper 24. In addition, the hopper further comprises two augers: a lower "feed" auger 27, such as a blade auger 27, disposed in the channel 25 that is designed to convey formed ice cubes in the channel from the low end of the hopper 24 towards the high end of the hopper; and an upper "whip" or stirring auger 29 designed to break up clusters of ice cubes and/or to stir the ice occasionally so that it does not "fuse" or melt and re-freeze into large lumps while awaiting bagging. The use of both types of augers 27 and 29 in combination assists in the smooth flow of formed ice cubes through the ice chute 14 and into the plurality of empty ice bags 8.

Figure 15:
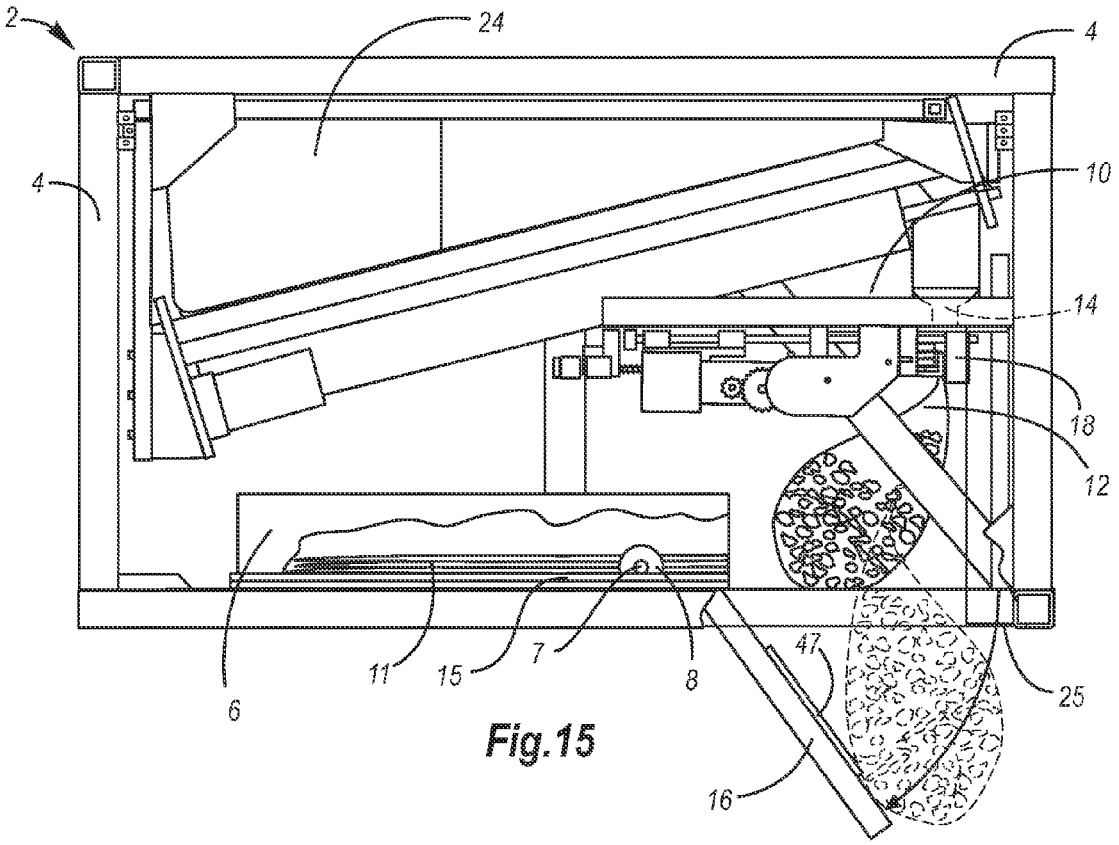
FIG. 15 illustrates a fourth in-use view of the ice bagging apparatus of FIG. 11.

In some particular implementations, at least one load sensor 33 may be interposed between the ice cube hopper 24 and the support frame 4 at one or both ends of the ice cube hopper 24. A load sensor 33 (also called a load cell) may be used in conjunction with an ice bagging assembly and/or a hopper 24 in various ways and for various purposes such as, by way of non-limiting example, to assist in determining when an ice cube hopper 24 and/or one or more of the plurality of empty ice bags 8 is full of ice and/or still empty. Specifically, by measuring the amount of load on the load cell 33 when an ice cube hopper 24 is full (thereby establishing a "full-load" measurement), an ice cube maker 52 can be programmed to begin ice production when the load on the load cell 33 corresponds to a less than full load (and/or to stop ice production when the load cell indicates a full ice hopper 24). Similarly, the weight of ice cubes introduced into an ice bag can be determined by measuring a decreasing load on the load cell 33, such that ice cubes are no longer introduced into an ice bag when a load on the load cell 33 has decreased to a pre-determined range. It will be understood that the quantity of ice to be placed in a hopper and/or an ice bag may be measured in other ways such as, by way of non-limiting example, weighing an ice bag and/or using a camera, laser-level, or other optical device to measure the amount of ice in the bag. For example, as illustrated in FIGS. 14-15, a load sensor 47 may be placed under the ice bag as it is being filled, such as by being built into the housing below the ice bag, so that the ice being put into the ice bag may be weighed near the time it is put into the ice bag. Alternatively, or in combination with weighing the ice, a level sensor 53, 54 may be included near the hopper and/or adjacent to the ice bag. For a level sensor 53 adjacent to the hopper, the level sensor, which may comprise a laser level, optical sensor, radio wave sensor and/or other level sensor, the level sensor may sense the level of ice within the hopper to determine how much the level has decreased when an ice bag is filled to estimate the quantity of ice being placed in the ice bag. Alternatively, or additionally in particular implementations, a level sensor adjacent to the hopper, which may comprise level sensors coupled to the hopper or to the frame within the hopper near the open top end of the hopper, the level sensor may be configured to sense or otherwise detect the level of the ice within the hopper to determine when the level of the ice within the hopper increases to a particular predetermined level at which a signal is sent to the ice cube maker 52 to indicate that it should stop sending ice to the hopper. When the level of ice within the hopper decreases to a particular predetermined level where additional ice is desired, a signal is sent to the ice cube maker 52 to indicate that it should start sending ice to the hopper again. For a level sensor 54 adjacent to the ice bag, a level sensor may sense a level of the ice as it is being placed into the ice bag to determine when the ice within the bag has reached a predetermined height considered appropriate for the weight of the ice desired within the bag. The ice bag could be filled, measured and if low then filled a little more to bring it to the proper height corresponding to the desired weight of ice to be placed in the ice bag.

Referring specifically to FIG. 15, as the first empty ice bag 12 (or another empty ice bag) is filled with ice cubes, an ice bag support 16 located below an end of the ice chute 14 is positioned to support the empty ice bag as ice cubes drop into the bag from the ice chute 14, Once a previously-empty ice bag has been at least partially filled with ice to a desired level, a conventional ice bag sealing mechanism 18 (which may comprise a heat-sealer, in some particular implementations) may seal the open end 20 of the filled ice bag. Once filled and sealed, ice bags may be provided to users in a variety of ways, such as via an ice bag merchandiser 22 (FIG. 1), which may be provided in some particular implementations.

An ice bag merchandiser 22 (FIG. 1) is configured to maintain the ice within the filled ice bags in a frozen state. The merchandiser 22 may be in mechanical cooperation with an ice bagging assembly (such as ice bagging assembly 2) such that the ice bag merchandiser 22 receives a plurality of filled, sealed ice bags from the ice bagging assembly. The plurality of filled, sealed ice bags may be received in the ice bag merchandiser 22 via a hatchway 25 (FIGS. 8 and 15) which, in some particular implementations, may comprise a diverter or other ice bag distributor. An example of a diverter is provided in in U.S. patent application Ser. No. 12/539,541 to Shaker, et al filed on Aug. 11, 2009, the disclosure of which is hereby incorporated by reference. In some particular implementations, an ice bag support 16 is configured to act as a trap-door with respect to a hatchway 25, such that the ice bag support 16 gives way once an ice bag has been filled and sealed, allowing the filled, sealed ice bag to pass through the hatchway 25 (as shown in FIG. 15).

Referring specifically to FIGS. 11-13, in some particular implementations, a bag selector 10 comprises at least one pair of opposed grasping elements 36 configured to grasp a first ply 30 of a first empty ice bag 12 from the plurality of empty ice bags 8. Once it has grasped the first ply 30 of the first bag 12, the bag selector 10 is configured to move the first empty ice bag 12 from a first position 37 within the ice bag cassette 6 to a second position 38 outside the cassette such that an open end 20 of the first empty ice bag 12 is positioned below an ice chute 14. A pickup sensor is included above the opposed grasping elements 36 to sense that the bag has been grasped by the grasping elements 36. The pickup sensor may include an optical sensor, a mechanical sensor, or any other sensor that can detect when the first ply 30 of the empty ice bag 12 has been grasped. Confirmation that the empty ice bag 12 has been grasped prior to movement toward a position below the ice chute significantly increases reliability of the system.

In those particular implementations comprising at least one pair of opposed grasping elements 36, the pair of grasping elements 36 may include at least one first wheel 40 configured to rotate about an axis (the other element of the pair of grasping elements 36 may be movable or stationary, depending upon the particular implementation). In some particular implementations, the at least one pair of grasping elements 36 may include at least two opposed wheels (e.g., at least one first wheel 40 and at least one second wheel 42, as shown in FIG. 11), with each of the wheels 40 and 42 configured to rotate about its respective axis in a direction opposite the other opposed wheel. For instance, if the first wheel 40 rotates clockwise, the second wheel 42 may rotate counterclockwise to draw the first layer of the bag up between the wheels 40, 42. By extension, if the first wheel 40 rotates counterclockwise, the second wheel 42 may rotate clockwise.

In yet other particular implementations, the at least one pair of opposed grasping elements 36 may comprise at least two pairs of opposed grasping elements 36, with each pair grasping a different ply of the first ply 30 and the second ply 32 of a first empty ice bag 12. In such particular implementations, the at least one pair of opposed grasping elements 36 each comprise at least one first wheel 40 configured to rotate about an axis. In any event, at least one pair of opposed grasping elements 36 is configured to move away from the second ply 32 of an empty ice bag 12 after grasping the first ply 30, such that the open end 20 of the empty ice bag 12 opens (it will be understood that the second ply 32 may be restrained by a second pair of opposed grasping elements 36, or in another way, such as via one or more suspension elements 50). It will be understood that one or more of the wheels 40 and 42 (and or other portions defining a pair of opposed grasping elements 36) may be formed with, or from, materials having a high co-efficient of friction such as, by way of non-limiting example, textured plastic or metal, or textured or untextured rubber, silicone, or knurled stainless steel. In addition, while the wheels shown and described herein are shown as being round, it will be understand that, in some particular implementations, one or more wheels 40 or 42 may comprise a perimeter or other shape other than round.

Referring to FIGS. 11-14, a non-limiting method of selecting and filling a plurality of empty ice bags 8 from a horizontal ice bag cassette 6 is illustrated. A bag selector 10 moves from a rest position 43 to a first bag selector position 44 above a horizontally-oriented ice bag cassette 6 such that the bag selector 10 may grasp a first ply 30 of an empty ice bag 12 (of the plurality of empty ice bags 8) in a horizontal position 46 in the horizontal ice bag cassette 6. The second ply 32 of the empty ice bag 12 may be restrained such that an open dimension 48 of the open end 20 of the empty ice bag 12 is increased as the one or more opposed grasping elements 36 of the bag selector 10 (that have grasped the first ply 30) move away from the restrained second ply 32. The bag selector 10 is further configured to move away from the horizontal ice bag cassette 6 after grasping the first ply 30 of the empty ice bag 12, such that the bag selector 10 positions the open end 20 of the empty ice bag 12 facing upwardly below an ice chute 14 (FIGS. 13-14). As illustrated by FIG. 14, the method further includes dropping a plurality of ice cubes from the ice chute 14 into the empty ice bag 12, sensing an amount of ice placed in the ice bag 12, then sealing the open end 20 of the empty ice bag 12 after dropping the ice cubes into the bag.

Depending upon the particular implementation being used, a method of selecting and filling a plurality of empty ice bags 8 from a horizontal ice bag cassette 6 may comprise moving at least one pair of grasping elements 36 into contact with the first ply 30 of the empty ice bag 12 and rotating at least one grasping element (of the at least one pair of grasping elements 36) with respect to the other grasping element of the at least one pair, in order to grasp the first ply 30. In some particular implementations, both grasping elements of the at least one pair of grasping elements 36 may be rotated in opposite directions to grasp the first ply 30.

While some particular implementation of bag selectors 10 may comprise at least two pairs of opposed grasping elements 36, with each pair grasping a different one of the first and second plys, other particular implementations of a bag selector 10 may include one or more suspension elements 50 opposed to at least one pair of opposed grasping elements 36. In those particular implementations of a bag selector 10 having one or more suspension elements 50 opposed to at least one pair of opposed grasping elements 36, a second ply 32 of the empty ice bag 12 may be restrained by passing one or more suspension elements 50 through the second ply 32 of the empty ice bag 12 in the horizontal position. It will be understood that the second ply 32 may include one or more holes or perforations to assist in the passage therethrough of one or more suspension elements 50.

A method of selecting and filling a plurality of empty ice bags 8 from a horizontal ice bag cassette 6 may further include measuring a quantity of ice dropped into the empty ice bag 12 by sensing the weight of the ice cube hopper 24 through a sensor (such as a load sensor) interposed between the ice cube hopper 24 and a support frame 4 for the ice cube hopper, or by other methods described more fully above.

In those particular implementations of a bag selector 10 having a ice bag cassette 6 that is not horizontally-oriented, a method of selecting and filling a plurality of empty ice bags 8 may comprise moving a bag selector 10 from a rest position 43 to a first bag selector position 45 adjacent to an ice bag cassette 6 by moving at least one pair of opposed grasping elements 36 into contact with the first ply 30 of the empty ice bag 12 and rotating at least one grasping element of the at least one pair of opposed grasping elements 36 with respect to the other grasping element of the at least one pair of opposed grasping elements 36 in order to grasp the first ply 30. As with those particular implementations having a horizontally-oriented ice bag cassette, the second ply 32 of the empty ice bag 12 may be restrained such that an open dimension 48 of the open end 20 of the empty ice bag 12 is increased as the one or more opposed grasping elements 36 of the bag selector 10 (that have grasped the first ply 30) move away from the restrained second ply 32. The bag selector 10 is further configured to move away from the horizontal ice bag cassette 6 after grasping the first ply 30 of the empty ice bag 12, such that the bag selector 10 positions the open end 20 of the empty ice bag 12 facing upwardly below an ice chute 14. The method further includes dropping a plurality of ice cubes from the ice chute 14 into the empty ice bag 12, and then sealing the open end 20 of the empty ice bag 12 after dropping the ice cubes into the bag.

Depending upon the particular implementation being used, a method of selecting and filling a plurality of empty ice bags 8 may comprise rotating both grasping elements of the at least one pair of grasping elements 36 in opposite directions to grasp the first ply 30. One or more suspension elements 50 opposed to at least one pair of opposed grasping elements 36 may be passed through the second ply 32 of the empty ice bag 12 such that the second ply 32 is restrained.

Figure 16:
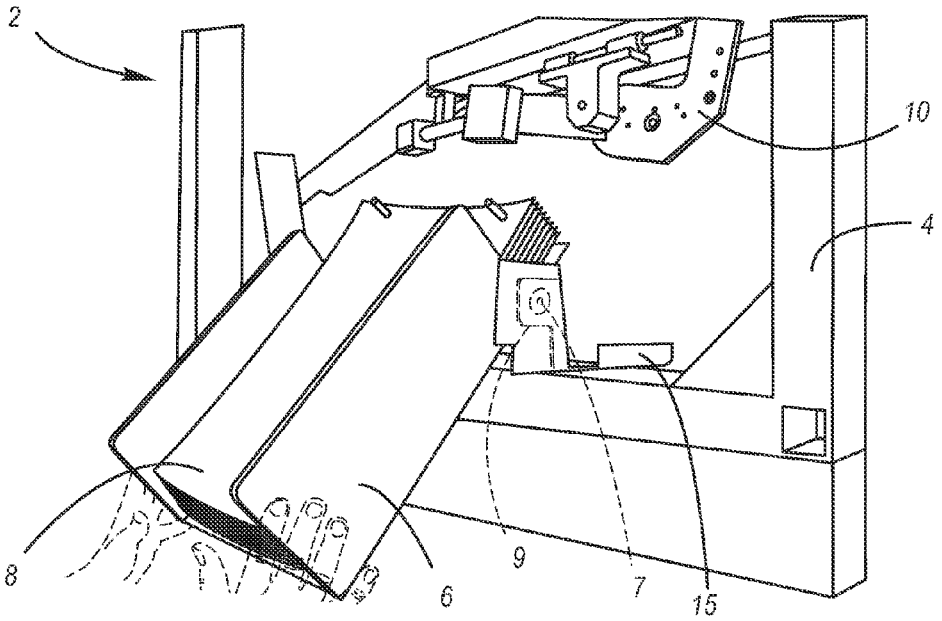
FIG. 16 illustrates a perspective side view of a particular implementation of an ice bagging apparatus with a slidable, tiltable bag cassette.

Turning now to FIG. 16, in some particular implementations, an ice bag cassette 6 may be rotatably, slidably and/or tiltably coupled to the support frame 4 to further assist with the replacement of the plurality of empty ice bags 8. A comparison of FIG. 15 to FIG. 16 illustrates that an ice bag cassette 6 may be capable of being rotated 90° with respect to the frame 4. Moreover, an ice bag cassette 6, whether it rotates or not, may slide with respect to the frame 4 via the mechanical cooperation of one or more wheels 7 or sliding elements with one or more tracks 15 (FIG. 12). As the ice bag cassette 6 is slid out to its fully extended position, the one or more wheels 7 may come to rest in one or more wheel catches 9. Once at its fully extended position, an ice bag cassette may be tilted with respect to the frame 4 (e.g. the one or more wheels 7 may have sufficient space to travel within the one or more wheel catches 9 to allow the cassette 6 to tilt, as shown in FIG. 16).

It will be understood by those of ordinary skill in the art that the concepts of providing a plurality of sealed ice bags to consumers, as disclosed herein, is not limited to the specific implementations shown and described herein. For example, it is specifically contemplated that the components included in any particular implementation of an ice bagging assembly may be formed of many different types of materials and/or combinations of materials that can readily be formed into shaped objects and that are consistent with the intended operation of an ice bagging assembly. For example, it is specifically contemplated that the components included in a particular implementation of an ice bagging assembly may be formed of any of many different types of materials or combinations that can readily be formed into shaped objects and that are consistent with the intended operation of an ice bagging assembly. For example, the components may be formed of: metals and/or other like materials; alloys and/or other like materials; polymers and/or other like materials; plastics, and/or other like materials; composites and/or other like materials; rubbers (synthetic and/or natural) and/or other like materials; and/or any combination of the foregoing.

Furthermore, the particular support frames, horizontal ice bag cassettes, bag selectors, plurality of ice bags, first bags, ice chutes, ice bag supports, sealing mechanisms, open ends, ice bag merchandisers, ice cube hoppers, load sensors, angled guides, ice bag cassettes, first plys, second plys, insides of ice bags, opposed grasping elements, first positions, second positions, wheels, horizontal positions, vertical positions, open dimensions, suspension elements, along with any other components forming a particular implementation of an ice bagging assembly, may be manufactured separately and then assembled together, or any or all of the components may be manufactured simultaneously and integrally joined with one another. Manufacture of these components separately or simultaneously may involve extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, and/or the like. If any of the components are manufactured separately, they may then be coupled or removably coupled with one another in any manner, such as with adhesive, a weld, a fastener, any combination thereof, and/or the like for example, depending on, among other considerations, the particular material(s) forming the components.

It will be understood that particular implementations of ice bagging assemblies are not limited to the specific components disclosed herein, as virtually any components consistent with the intended operation of a method and/or system implementation for an ice bagging assembly may be utilized. Accordingly, for example, although particular support frames, horizontal ice bag cassettes, bag selectors, plurality of ice bags, first bags, ice chutes, ice bag supports, sealing mechanisms, open ends, ice bag merchandisers, ice cube hoppers, load sensors, angled guides, ice bag cassettes, first plys, second plys, insides of ice bags, opposed grasping elements, first positions, second positions, wheels, horizontal positions, vertical positions, open dimensions, suspension elements, and other components may be disclosed, such components may comprise any shape, size, style, type, model, version, class, grade, measurement, concentration, material, weight, quantity, and/or the like, consistent with the intended operation of a method and/or system implementation for an ice bagging assembly, may be used.

In places where the description above refers to particular implementations of an ice bagging assembly, it should be readily apparent that a number of modifications may be made without departing from the spirit thereof and that these implementations may be applied to other ice bagging assemblies. The accompanying claims are intended to cover such modifications as would fall within the true spirit and scope of the disclosure set forth in this document. The presently disclosed implementations are, therefore, to be considered in all respects as illustrative and not restrictive, the scope of the disclosure being indicated by the appended claims rather than the foregoing description. All changes that come within the meaning of and range of equivalency of the claims are intended to be embraced therein.

The invention claimed is:

1. An ice bagging assembly having:

a support frame;

an ice cube hopper coupled to the support frame and configured to store a plurality of ice cubes;

an ice chute in mechanical cooperation with the ice cube hopper, the ice chute configured to drop a plurality of ice cubes into an open ice bag; and at least one load sensor interposed between the ice cube hopper and the support frame and configured to measure a combined weight of the hopper and ice within the hopper to determine an amount of ice in the hopper, wherein the at least one load sensor is in communication with the ice chute such that the plurality of ice cubes are no longer dropped into the open ice bag when the combined weight of the hopper and ice within the hopper as determined by the load sensor has decreased by a pre-determined amount.

2. The assembly of claim 1, further comprising a sealing mechanism configured to seal an open end of the open ice bag.

3. The assembly of claim 1, wherein the at least one load sensor is in communication with an ice cube maker such that the ice cube maker begins making ice cubes when the ice cube hopper is less than full and stops making ice cubes when the ice cube hopper is full as determined by the at least one load sensor.

* * * * *